US009981815B2

(12) United States Patent
Yanagida

(10) Patent No.: US 9,981,815 B2
(45) Date of Patent: May 29, 2018

(54) TRANSPORT DEVICE

(71) Applicant: FUJITSU FRONTECH LIMITED, Inagi (JP)

(72) Inventor: Hiroshi Yanagida, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days. days.

(21) Appl. No.: 15/423,066

(22) Filed: Feb. 2, 2017

(65) Prior Publication Data

US 2017/0144850 A1 May 25, 2017

Related U.S. Application Data

(63) Continuation of application No. PCT/JP2014/072618, filed on Aug. 28, 2014.

(51) Int. Cl.
*B65H 5/06* (2006.01)

(52) U.S. Cl.
CPC ..... *B65H 5/062* (2013.01); *B65H 2404/1341* (2013.01); *B65H 2404/1345* (2013.01); *B65H 2404/144* (2013.01); *B65H 2404/172* (2013.01); *B65H 2701/1912* (2013.01)

(58) Field of Classification Search
CPC .... B65H 2404/1341; B65H 2404/1345; B65H 2404/1421; B65H 2404/14211; B65H 2404/17; B65H 2301/33312; B65H 5/062; B65H 2404/144; B65H 2404/172; B65H 2404/174
See application file for complete search history.

(56) References Cited

U.S. PATENT DOCUMENTS 3,017,061 A * 1/1962 Hobart ..... B65H 5/062 226/177
4,850,584 A * 7/1989 Watashi ..... B65H 27/00 271/274
7,988,149 B2 * 8/2011 Terada ..... B65H 5/062 271/272

(Continued)

FOREIGN PATENT DOCUMENTS

JP 8-91621 4/1996
JP 11-124246 5/1999

(Continued)

OTHER PUBLICATIONS

International Search Report Dated Oct. 28, 2014 in corresponding International Application No. PCT/PCT/JP2014/072618.

(Continued)

*Primary Examiner* — Jeremy R Severson
(74) *Attorney, Agent, or Firm* — Staas & Halsey LLP

(57) ABSTRACT

A transport device includes a drive roller and a driven roller. The drive roller transports paper-sheets in a predetermined transport direction by rotation thereof. The driven roller rotates with rotation of the drive roller, and regardless of from which direction the paper-sheets hit a contact point with the first roller, moves in a direction diagonally forward than a vertical direction with respect to the transport direction. The transport device further includes a bearing groove formed so that a shaft of the driven roller moves in a direction diagonally forward than the vertical direction with respect to the transport direction along an inclined surface.

4 Claims, 8 Drawing Sheets

(56) References Cited

U.S. PATENT DOCUMENTS

| | | | | |
|---|---|---|---|---|
| 8,490,969 | B2 * | 7/2013 | Sawamura | B65H 29/125 271/207 |
| 8,701,555 | B2 * | 4/2014 | Bell, Jr. | B65B 13/22 100/29 |
| 8,876,111 | B1 * | 11/2014 | Lan | B65H 5/06 271/273 |
| 8,909,123 | B2 * | 12/2014 | Moriyama | B41J 3/60 399/361 |
| 8,998,206 | B2 * | 4/2015 | Hiyama | B65H 29/58 271/272 |
| 9,546,060 | B2 * | 1/2017 | Tashiro | B65H 5/068 |
| 2007/0145679 | A1 * | 6/2007 | Terada | B41J 11/0005 271/272 |
| 2009/0166962 | A1 * | 7/2009 | Osakabe | H04N 1/0057 271/264 |
| 2010/0296856 | A1 | 11/2010 | Moriyama | |
| 2012/0153567 | A1 * | 6/2012 | Sawamura | B65H 29/125 271/272 |
| 2014/0124334 | A1 | 5/2014 | Sado | |
| 2014/0145396 | A1 | 5/2014 | Hiyama | |
| 2014/0210160 | A1 | 7/2014 | Akimatsu | |
| 2014/0306396 | A1 * | 10/2014 | Lan | B65H 5/06 271/3.19 |

FOREIGN PATENT DOCUMENTS

| | | |
|---|---|---|
| JP | 2004-54809 | 2/2004 |
| JP | 2007-84225 | 4/2007 |
| JP | 2010-269886 | 12/2010 |
| JP | 2011-26080 | 2/2011 |

OTHER PUBLICATIONS

Chinese Office Action dated Aug. 1, 2017 in corresponding Chinese Patent Application No. 201480081477.5.

Extended European Search Report dated Jul. 21, 2017 in corresponding European Patent Application No. 14900506.8.

Office Action dated Mar. 23, 2018 in corresponding Chinese Patent Application No. 201480081477.5, 11 pgs.

* cited by examiner

TRANSPORT DEVICE

CROSS-REFERENCE TO RELATED APPLICATION

This application is a continuation application of International Application PCT/JP2014/072618, filed on Aug. 28, 2014 and designating the U.S., the entire contents of which are incorporated herein by reference.

FIELD

The present invention relates to a transport device.

BACKGROUND

Conventionally, paper-sheet processing devices including an automated teller machine (ATM) that perform deposit and dispense of banknotes or the like have been used. In recent years, introduction of the paper-sheet processing devices in developing countries have accelerated. However, in developing countries, due to paper quality and an influence of weather (such as high temperature and humidity), damage on the tip of the banknotes is likely to occur by an impact caused when the banknotes hit a transport roller. Such damage on the banknotes becomes a cause of jamming.

Banknotes are transported between a drive roller driven by a motor and a driven roller (a pinch roller) that rotates with rotation of the drive roller. The driven roller is brought into pressure contact with the drive roller by a plate spring or a spring. Because a movable direction of the driven roller is vertical to a transport direction of the banknotes, pressure by the driver roller becomes a brake force with respect to the transported banknotes. The brake force damages the tip of the banknotes moving into between the rollers.

Patent Document 1: Japanese Laid-open Patent Publication No. 2011-26080

Patent Document 2: Japanese Laid-open Patent Publication No. 2004-54809

In order to reduce the brake force described above, there is a method in which a driven roller is moved in a direction different from the vertical direction (for example, in a direction slightly diagonally forward than the vertical direction with respect to the transport direction) by using metal fittings having different fulcrum shaft. However, according to this method, it is difficult to be responsive to bi-directional transport. That is, when the driven roller moves in a direction slightly diagonally forward than the vertical direction with respect to the transport direction, if banknotes move into the movable direction of the driven roller, the brake force is absorbed, thereby easing damage caused by hitting of the banknotes. On the other hand, if the banknotes move from a direction opposite to the movable direction, the brake force due to pressing of the driven roller increases, thereby causing an opposite effect.

SUMMARY

According to an aspect of the embodiments, a transport device includes: a first roller that transports paper-sheets in a predetermined transport direction by rotation thereof; and a second roller that rotates with rotation of the first roller, and regardless of from which direction the paper-sheets hit a contact point with the first roller, moves in a direction diagonally forward than a vertical direction with respect to the transport direction.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Exemplary embodiments of a transport device disclosed in the present application will be explained below in detail with reference to the accompanying drawings. The transport device disclosed in the present application is not limited to the following embodiments. In the following descriptions, as an example, a banknote processing device including the transport device is assumed to be a self-checkout resister; however, the present invention is not limited thereto.

First Embodiment

Figure 1:
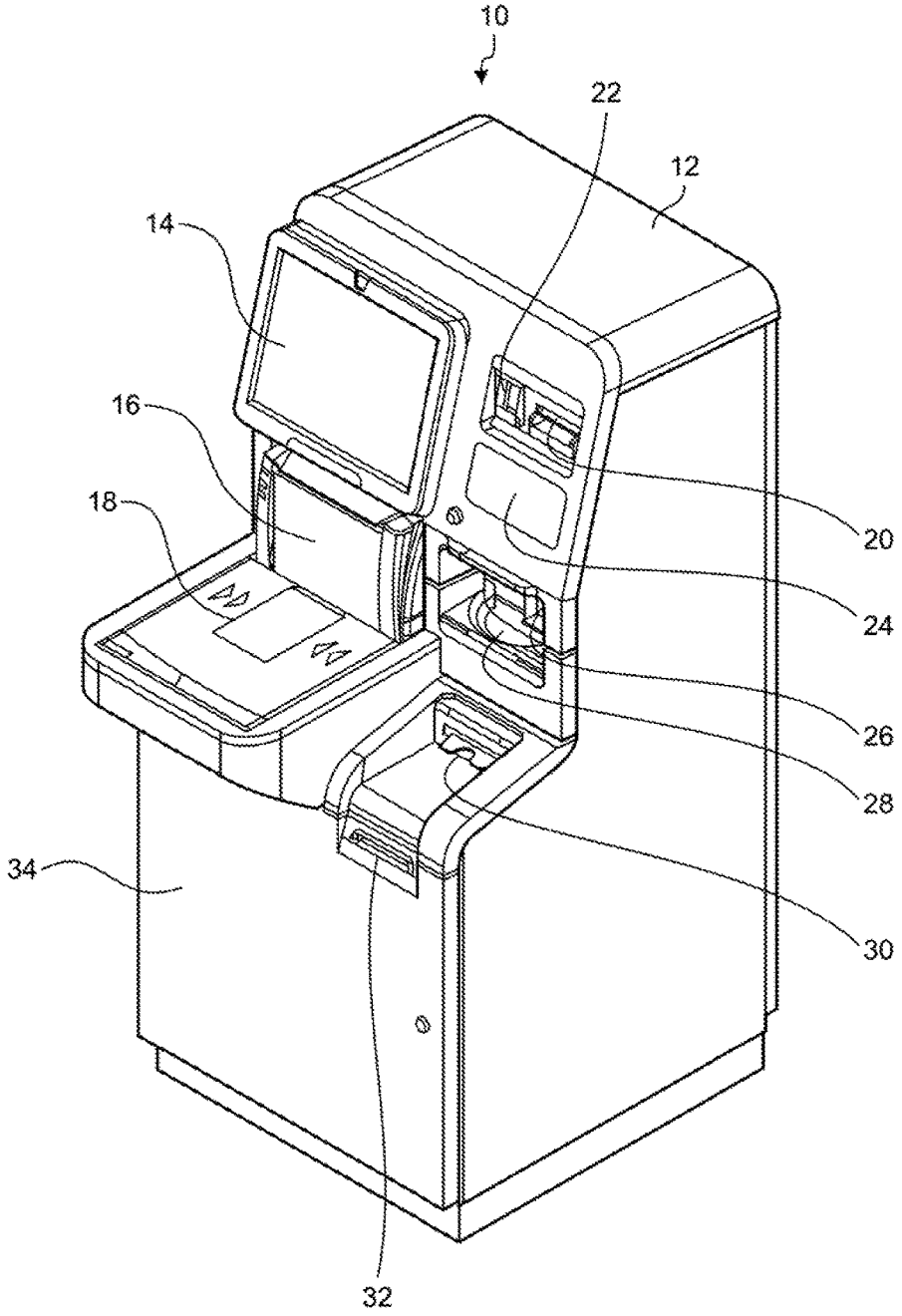
FIG. 1 is a diagram illustrating an example of an exterior view of a banknote processing device having a transport device according to a first embodiment.

FIG. 1 is a diagram illustrating an example of an exterior view of a banknote processing device 10 having a transport device according to a first embodiment. In FIG. 1, the banknote processing device 10 includes a device casing 12. FIG. 1 is a perspective view of the banknote processing device 10 as seen from a diagonally upper right direction. That is, in FIG. 1, the side attached with a touch panel 14 corresponds to "front" of the banknote processing device 10.

The touch panel 14 is provided at an upper left position on the front face of the device casing 12. The touch panel 14 displays various pieces of information presented to a user, and accepts operations by the user.

A scanner 16 is provided below the touch panel 14 on the front, face of the device casing 12. When a code symbol attached to an item that a customer wants to purchase (that is, a to-be-purchased item) is held over the scanner 16, the scanner 16 reads information of the code symbol, and outputs the read information to a control unit (not illustrated). The code symbol is, for example, a one-dimensional bar code or a two-dimensional bar code.

A scale 18 projecting from the front face of the device casing 12 is provided at a position below the scanner 16. The scale 18 measures the weight of a to-be-purchased item placed thereon by the user, and outputs information relating to the measured weight to the control unit (not illustrated). Accordingly, the control unit (not illustrated) can perform "checking process" to determine whether the item whose information is read by the scanner 16 matches the item whose weight has been measured.

A banknote slot 20 and a coin slot 22 are provided side by side at an upper right position on the front face of the device casing 12. The banknote slot 20 and the coin slot 22 are used when a customer makes payment. Of the price to be paid, banknotes are inserted into the banknote slot 20 and coins are inserted into the coin slot 22.

A card reader 24 is provided at a position below the banknote slot 20 and the coin slot 22 on the front face of the device casing 12.

A receipt issuing port 26 and a coin discharge port 28 are provided at positions below the card reader 24 on the front face of the device casing 12. When the user finishes payment, a receipt is discharged from the receipt issuing port 26. Further, when the payment is completed or the transaction cancelled, coins as the change or coins to be returned are discharged from the coin discharge port 28.

A banknote discharge port 30 is provided at a position below the receipt issuing port 26 and the coin discharge port 28 on the front face of the device casing 12. When the payment is completed or the transaction is cancelled, banknotes as the change or banknotes to be returned are discharged from the banknote discharge port 30.

A coupon port 32 is provided at a position below the banknote discharge port 30 on the front face of the device casing 12. A door 34 is provided below the coupon port 32. A manager opens the door 34 to take out banknotes collected in, for example, a collection unit (not illustrated).

Figure 2:
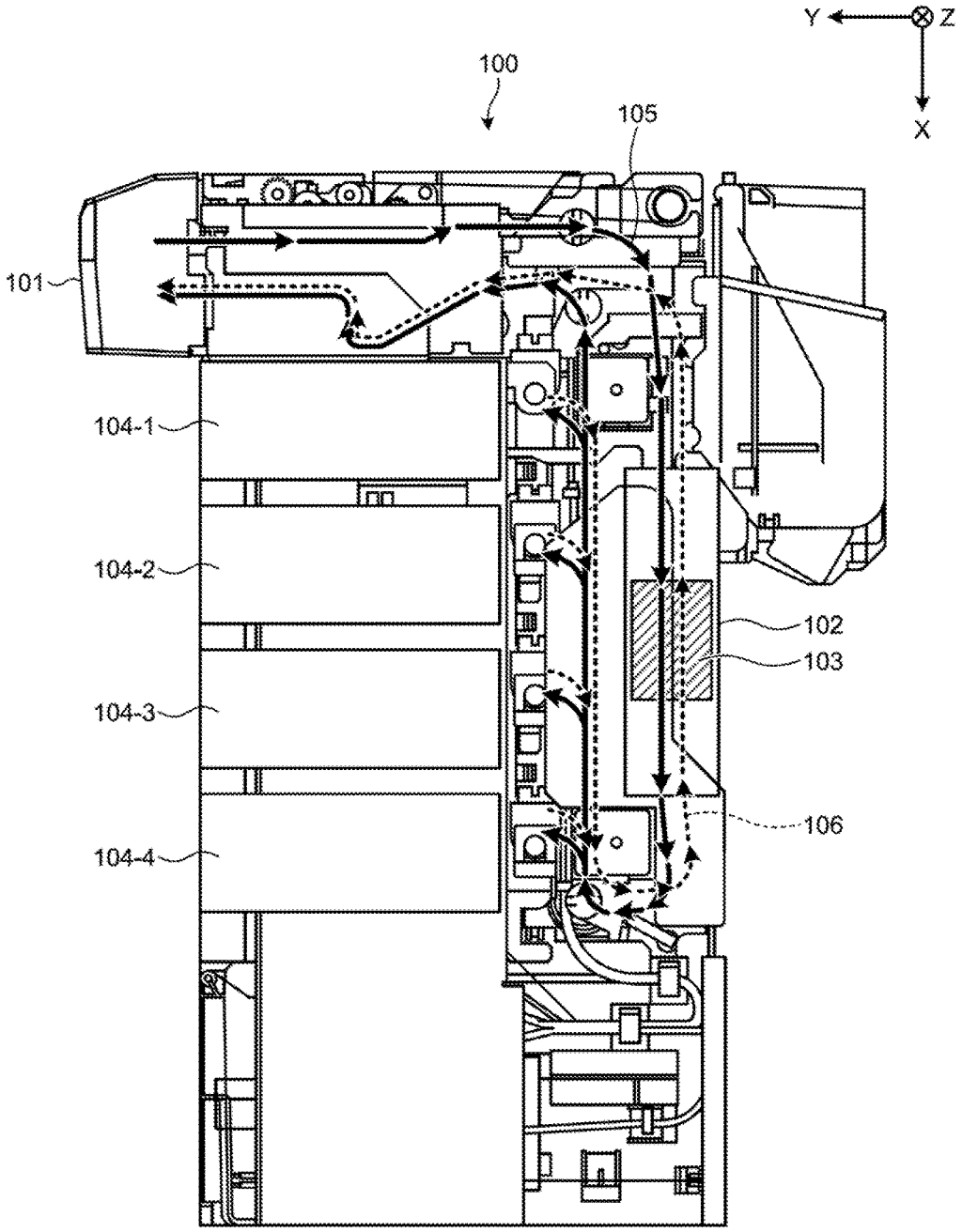
FIG. 2 is a side sectional view of the transport device according to the first embodiment.

FIG. 2 is a side sectional view of a transport device 100 according to the first embodiment. In the transport device 100, at the time of deposit, banknotes deposited from a deposit and dispense port 101 pass through a deposit transport path 105 and is transported to a BV (Bill Validator) 103 in a banknote processing unit 102, and validated by the BV 103. The banknotes, which are not counterfeits and whose banknote type and serial numbers can be discriminated to have a validation result being "OK", are transported to any of recycle stackers 104-1 to 104-4 according to the banknote type thereof after being discharged from the BV 103 and stored therein. For example, the recycle stacker 104-1 stores therein 10,000 yen notes, the recycle stacker 104-2 stores therein 5,000 yen notes, and the recycle stacker 104-3 stores therein 1,000 yen notes. On the other hand, for example, banknotes whose banknote type has not been discriminated by the BV 103 and whose validation result becomes "NG" at the time of deposit are not stored in the recycle stackers 104-1 to 104-4, and are returned to the deposit and dispense port 101 directly and returned to the user.

Further, at the time of dispense, the banknotes stored in the recycle stackers 104-1 to 104-4 pass through a dispense transport path 106 and are transported to the BV 103 in the banknote processing unit 102, where the banknotes are validated by the VB 103. The banknotes whose validation result becomes "OK" are discharged from the BV 103 and are transported to the deposit and dispense port 101 and dispensed. On the other hand, the banknotes whose validation result becomes "NG" at the time of dispense are transported to a predetermined box (not illustrated) in the transport device 100 and stored therein.

The transport device 100 transports the banknotes in the transport direction by a drive roller that is rotated by a motor and a driven roller that rotates with the rotation of the drive roller. The driven roller is brought into pressure contact with the drive roller, for example, by a plate spring or a spring. In order to reduce damage on the tip of the banknotes, it is desired to move the banknotes in a direction in which an impact caused when the banknotes hit a roller contact portion is absorbed (for example, in a direction slightly diagonally forward than the vertical direction with respect to the transport direction). Hereinafter, the reason thereof is described with reference to FIG. 3.

Figure 3:
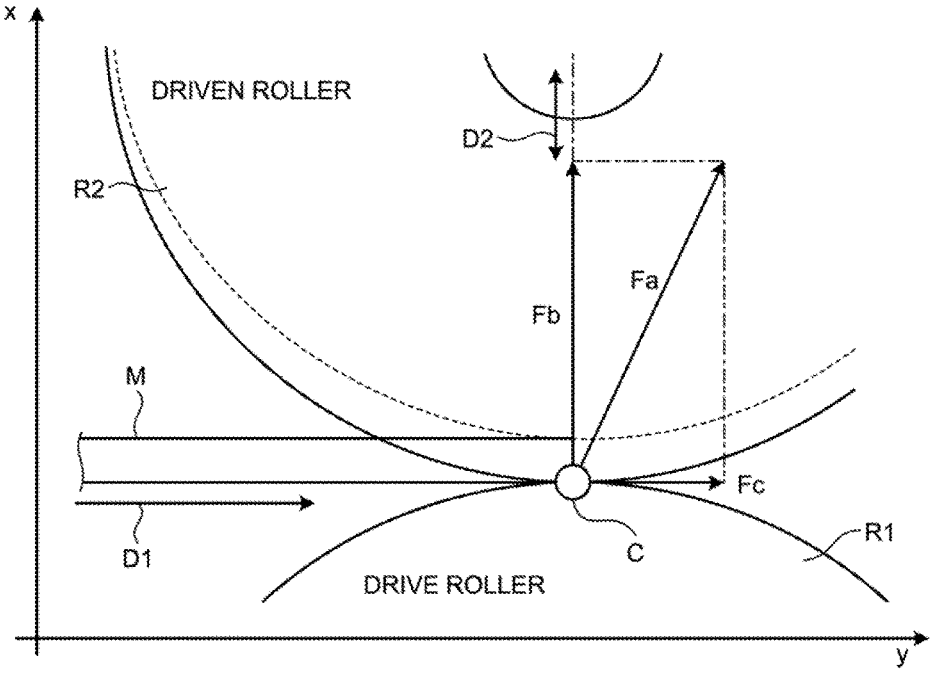
FIG. 3 is an explanatory diagram of a preferable movable direction or a driven roller.

FIG. 3 is an explanatory diagram of a preferable movable direction of a driven roller R2. In FIG. 3, a force Fa is a force applied to the driven roller R2 and a shaft thereof when a banknote M hits the driven roller R2. A force Fb is a component, force of the force Fa in the vertical direction (x-axis direction), and this force becomes a pressing force from the driven roller R2 to the drive roller R1. A force Fc is a component force of the force Fa in a horizontal direction (y-axis direction). As illustrated in FIG. 3, when a movable direction D2 of the driven roller R2 is the vertical direction (x-axis direction) with respect to a transport direction D1 of the banknote M, because the shaft of the driven roller R2 is not movable in the direction of the force Fc, the force Fc becomes a brake force applied to the tip of the banknote M. Accordingly, by moving the driven roller R2 in the direction of the force Fa, the transport device 100 absorbs the above brake force, thereby enabling to reduce damage on the banknote M. As a result, more stable and smooth infeed of banknotes to a roller contact portion C can be performed.

Figure 4A:
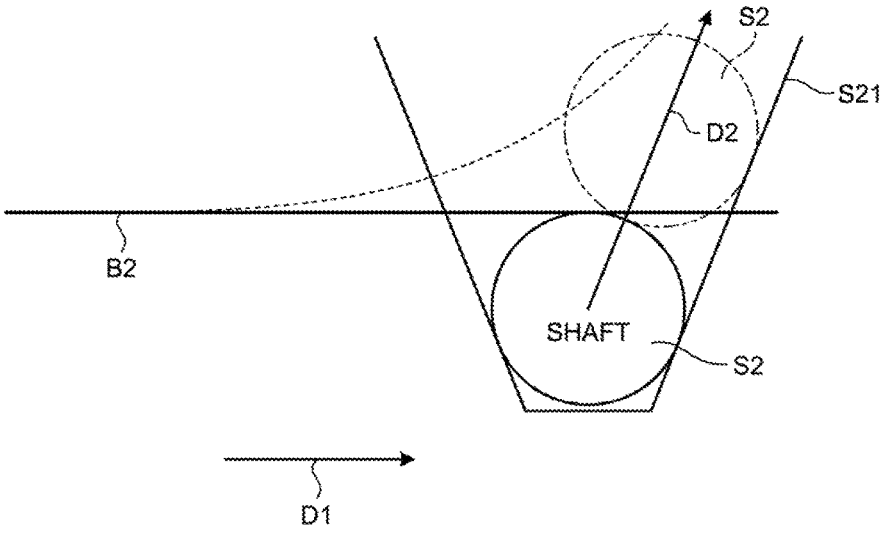
FIG. 4A is a side view illustrating a movable direction of a driven shaft when a transport direction of a banknote is rightward, in the transport device according to the first embodiment.
Figure 4B:
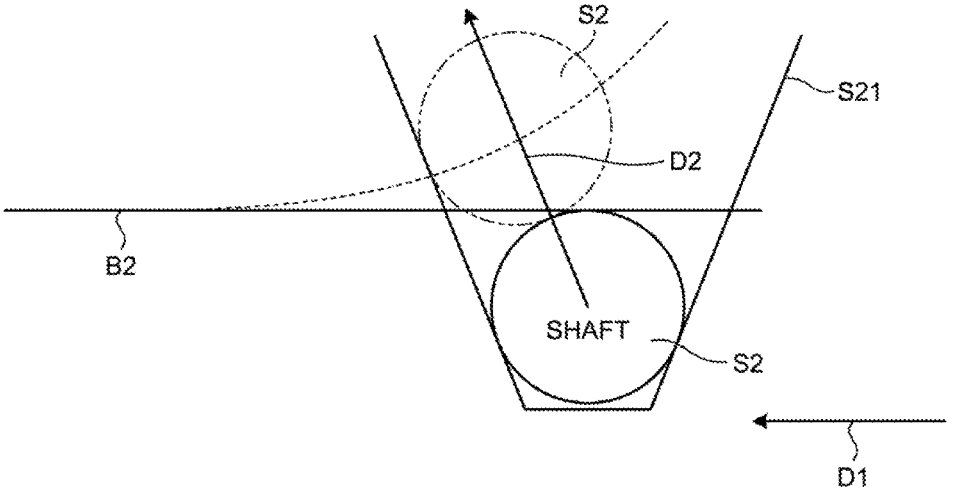
FIG. 4B is a side view illustrating a movable direction of the driven shaft when the transport direction of a banknote is leftward, in the transport device according to the first embodiment.

FIG. 4A is a side view illustrating the movable direction D2 of a driven shaft S2, when the transport direction D1 of the banknote M is rightward, in the transport device 100 according to the first embodiment. The movable direction of the driven shaft S2 of the driven roller R2 is determined according to the direction of a bearing groove S21 formed on both sides of the driven roller R2. Therefore, in the transport device 100, as illustrated in FIG. 4A, the shape of side surfaces of the bearing groove S21 is in a V shape, so that the driven shaft S2 can move not only in one direction but also in a diagonal direction. Accordingly, the force Fc is efficiently transferred to the driven shaft S2 to move the driven shaft S2. As a result, the brake force on the banknote M is reduced. FIG. 4B is a side view illustrating the movable direction D2 of the driven shaft S2, when the transport direction D1 of the banknote M is leftward, in the transport device 100 according to the first embodiment. As illustrated in FIG. 4B, when the banknote M hits the roller contact portion C leftward (in direction opposite to the case illustrated in FIG. 4A), the driven shaft S2 can move in a direction slightly diagonally leftward than the vertical direction with respect to the transport direction D1. Accordingly, damage due to hitting of the banknote M can be reduced regardless of the transport direction of the banknote M.

Figure 5A:
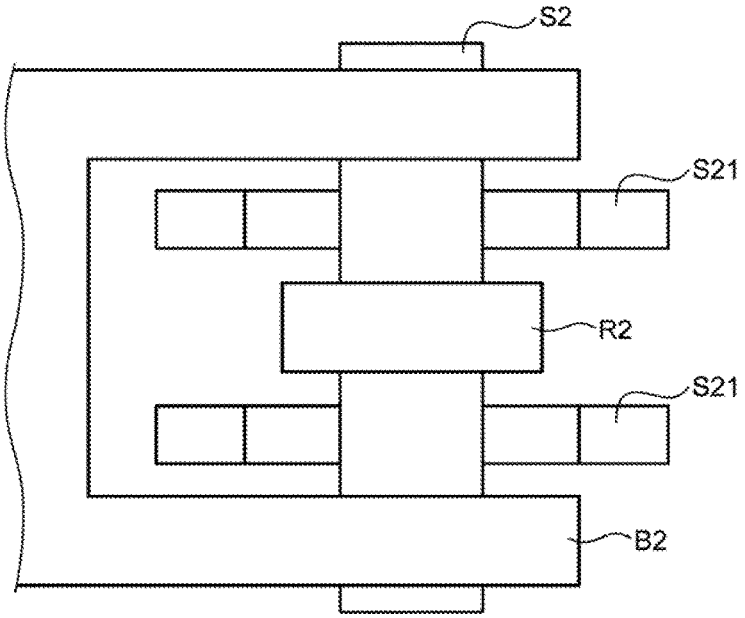
FIG. 5A is a top view of a bearing groove according to the first embodiment.
Figure 5B:
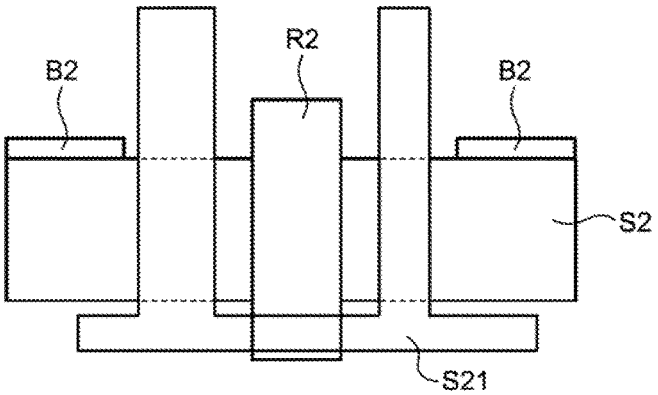
FIG. 5B is a front view of the bearing groove according to the first embodiment.

FIG. 5A is a top view of the bearing groove S21 according to the first embodiment. FIG. 5B is a front view of the bearing groove S21 according to the first embodiment. As illustrated in FIG. 5A and FIG. 5B, the driven shaft S2 of the driven roller R2 is fitted to the bearing groove S21 by elastic pressure of a plate spring B2, while maintaining variability in the moving direction.

As described above, the transport device 100 has the drive roller R1 and the driven roller R2. The drive roller R1 transports the banknote M in a predetermined transport direction by rotation thereof. The driven roller R2 rotates with the rotation of the drive roller R1. Even when the banknote M his the contact portion C with the drive roller R1 from any transport direction, the driven roller R2 moves diagonally forward than the vertical direction with respect to the transport direction. Further, the transport device 100 can include the bearing groove S21 formed so that the driven shaft S2 moves diagonally forward than the vertical direction with respect to the transport direction along an inclined surface. Due to this configuration, the driven roller R2 can move in the direction of the force Fa to absorb the brake force. As a result, the transport device 100 can reduce damage on the banknote M regardless of the transport direction of the banknote M.

First Modification

Figure 6:
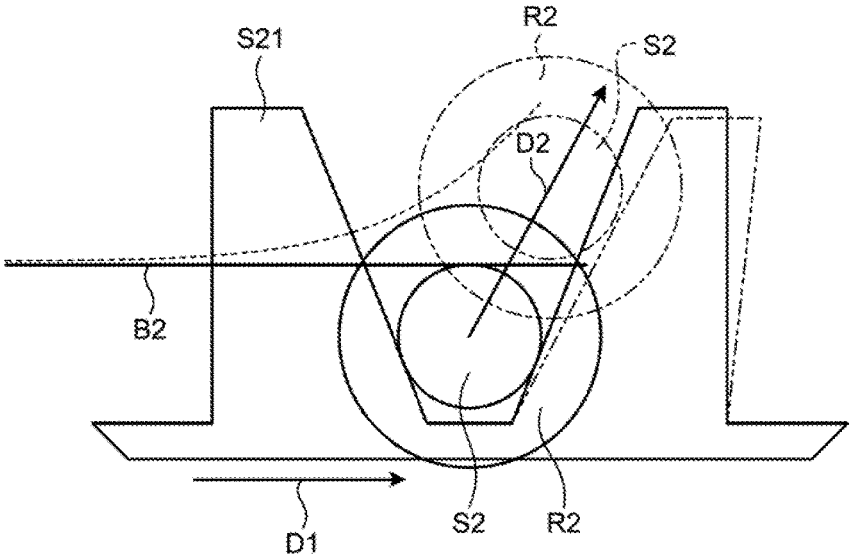
FIG. 6 is a side view of a bearing groove according to a first modification.

Next, a first modification is described. FIG. 6 is a side view of the bearing groove S21 according to the first modification. The bearing groove according to the first modification is identical to the bearing groove S21 of the first embodiment described above, except that the material thereof is an elastic member. Therefore, constituent elements in common with the first embodiment are denoted with like reference signs and detailed descriptions thereof will be omitted.

While reduction of the brake force Fc is possible in the bearing groove S21 according to the first embodiment, the angle of the force Fa takes various values depending on the thickness, the state (for example, the extent of damage), the transport speed, and the like of the banknote M. However, in the transport device 100 according to the first embodiment, because the inclination of the contact surface between the bearing groove S21 and the driven shaft S2 is fixed, it is difficult to move the driven shaft 32 with an optimum angle in accordance with the variation of the angle of the force Fa. Therefore, in the transport device 100 according to the first modification, as illustrated in FIG. 6, by forming the bearing groove S21 by an elastic member, the inclination of the contact surface between the bearing groove S21 and the driven shaft S2 is made variable. That is, the inclination surface of the bearing groove S21 has elasticity such that the inclination angle changes according to the direction and strength of the force applied thereto due to hitting of the banknote M. Accordingly, the bearing groove S21 can be moved more flexibly in accordance with the variation of the angle of the force Fa. As a result, more efficient reduction of the brake force Fc becomes possible.

In FIG. 6, as the transport direction D1 of the banknote M and the movable direction D2 of the driven shaft S2 of the driven roller R2, a right direction is exemplified. However, these directions can be opposite. Further, the elastic member constituting the bearing groove S21 can be not only rubber but also a plate spring or a coil spring, or a combination thereof. Further, the portion in which an elastic member is used does not have to be the entirety of the bearing groove S21. For example, only the inclined surface coming in contact with the driven shaft S2 and the vicinity thereof (for example, approximately 5 to 20 millimeters) of the bearing groove S21 can be formed by an elastic member in a range in which the brake force Fc can be absorbed sufficiently. Alternatively, only one inclined surface and the vicinity thereof out of the two inclined surfaces of the bearing groove S21 can be formed by an elastic member.

Second Modification

Figure 7:
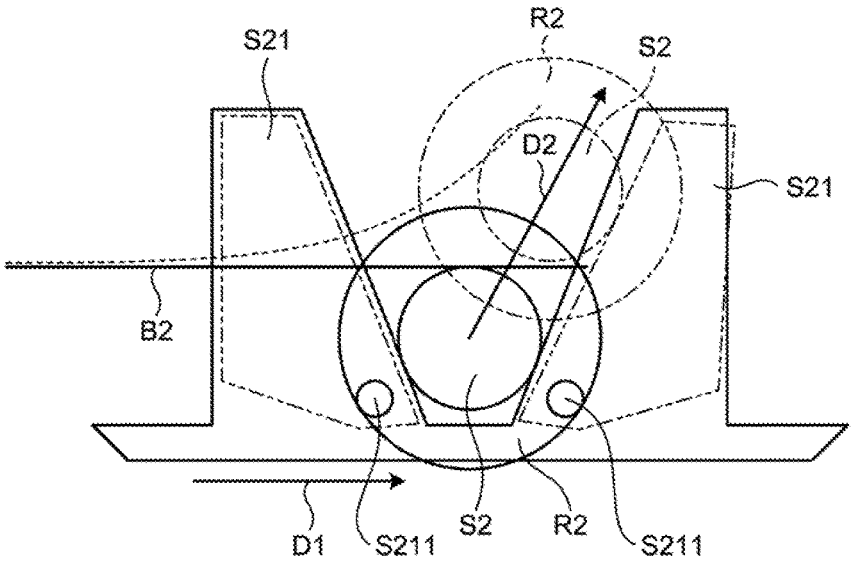
FIG. 7 is a side view of a bearing groove according to a second modification.

Next, a second modification is described. FIG. 7 is a side view of the bearing groove S21 according to the second modification. The bearing groove according to the second modification is identical to the bearing groove S21 of the first embodiment described above, except that the bearing groove is turnable depending on the angle of the force Fa. Therefore, constituent elements in common with the first embodiment are denoted with like reference signs and detailed descriptions thereof will be omitted.

In the transport device 100 according to the first modification, the hearing groove S21 is made movable by changing the material thereof. However, the transport device 100 according to the second modification has a mechanism as illustrated in FIG. 7, in which the bearing groove S21 can be turned around a rotary shaft S211. That is, the inclined surface of the bearing groove S21 turns so that the inclination angle thereof changes according to the direction and strength of the force applied due to hitting of the banknote M. Accordingly, the transport device 100 can change the inclination of the contact surface between the bearing groove S21 and the driven shaft S2 without changing the material thereof. Therefore, the bearing groove S21 can be moved more flexibly in accordance with the variation of the angle of the force Fa. As a result, more efficient reduction of the brake force Fc becomes possible.

In FIG. 7, as the transport direction D1 of the banknote M and the movable direction D2 of the driven shaft S2 of the driven roller R2, a right direction is exemplified. However, these directions can be opposite. Further, the movability of the bearing groove S21 does not have to be on the both sides, and it can be such that only one inclined surface out of the two inclined surfaces of the bearing groove S21 can turn around the rotary shaft S211 as a central axis. Further, the range of the turning angle of the bearing groove S21 can be different on the both sides. For example, the range of the inclination angle of the bearing groove S21 can be different such that the bearing groove S21 can be inclined between 0 to 10 degrees for rightward transport, and can be inclined between 5 to 20 degrees for leftward transport, depending on the thickness, the state (for example, the extent of damage), the transport speed, and the like of the banknote M.

Third Modification

Figure 8:
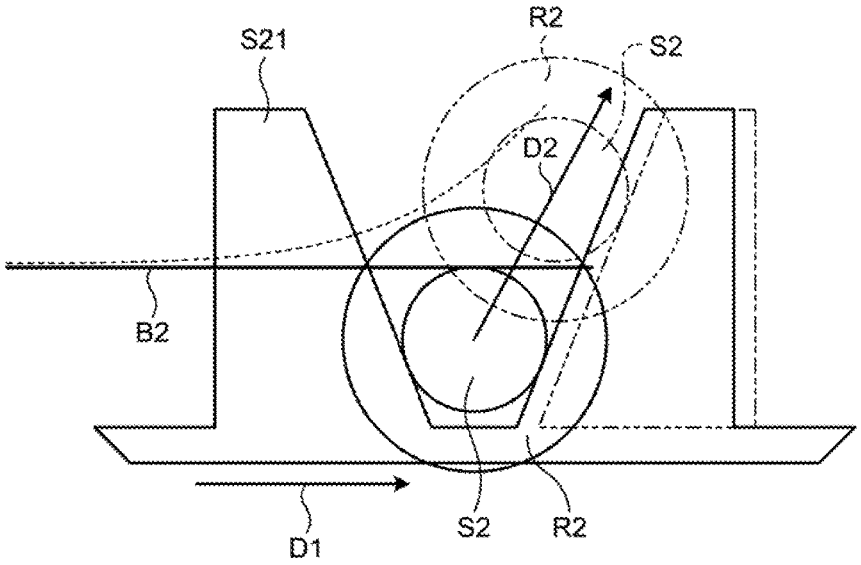
FIG. 8 is a side view of a bearing groove according to a third modification.

Next, a third modification is described. FIG. 8 is a side view of the bearing groove S21 according to the third modification. The bearing groove according to the third modification, is identical to the bearing groove S21 of the first embodiment described above, except that the bearing groove is slidable depending on the angle of the force Fa. Therefore, constituent elements in common with the first embodiment are denoted with like reference signs and detailed descriptions thereof will be omitted.

In the transport device 100 according to the second modification, the bearing groove S21 is made movable by the turning mechanism. The transport device 100 according to the third modification has a mechanism as illustrated in FIG. 8 in which the bearing groove S21 having the inclined surface can slide in a horizontal direction (bi-directionally). That is, the inclined surface of the bearing groove S21 moves (slides) in the transport direction according to the direction and strength of the force applied thereto due to hitting of the banknote M. Accordingly, the transport device 100 can make the bearing groove S21 responsive to variations of the angle of the force Fa flexibly and appropriately, without providing a turning mechanism. As a result, more efficient reduction of the brake force Fc becomes possible.

In FIG. 8, as the transport direction D1 of the banknote M and the movable direction D2 of the driven shaft S2 of the driven roller R2, a right direction is exemplified. However, these directions can opposite. Further, sliding of the bearing groove S21 does not have to be on the both sides, and it can be such that only one inclined surface out of the two inclined surfaces of the bearing groove S21 can slide. Further, a sliding distance range of the bearing groove S21 can be different on the both sides. For example, the movable width of the bearing groove S21 can be different such that the bearing groove S21 can slide up to 10 millimeters for rightward transport, and can slide up to 20 millimeters for leftward transport, according to the thickness, the state (for example, the extent of damage), the transport speed, and the like of the banknote M.

Further, in the transport device 100 according to the third modification, because the driven shaft S2 of the driven roller R2 is movable in the direction of the force Fc (see FIG. 3) with sliding of the bearing groove S21, the bearing groove S21 need not always have an inclination. That is, the transport device 100 can absorb the force Fc and reduce damage on the banknote M due to hitting thereof to the roller contact point C, without making the shape of the side surface of the bearing groove S21 in a V shape.

In the transport devices 100 according to the first to third modifications, the configuration can be such that at least one of the inclined surfaces is formed with a steeper inclination angle than the fixed inclined surface according to the first embodiment, because the two inclined surfaces of the bearing groove S21 are movable. For example, when the inclination angle of the bearing groove S21 in the first embodiment is between 50 to 70 degrees, the inclination angle of the bearing groove S21 in the first to third modifications can be between 60 to 80 degrees. Accordingly, the transport device 100 can be flexibly responsive to the angle (for example, 50 degrees to 80 degrees) of the force Fa in a wider range.

Fourth Embodiment

Figure 9A:
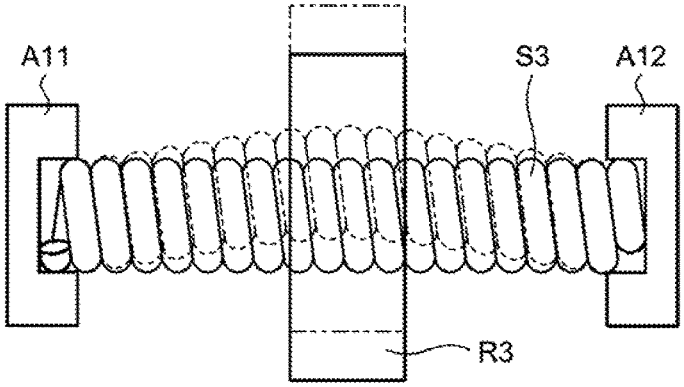
FIG. 9A is a front view of a driven-shaft of a driven roller according to a fourth modification.
Figure 9B:
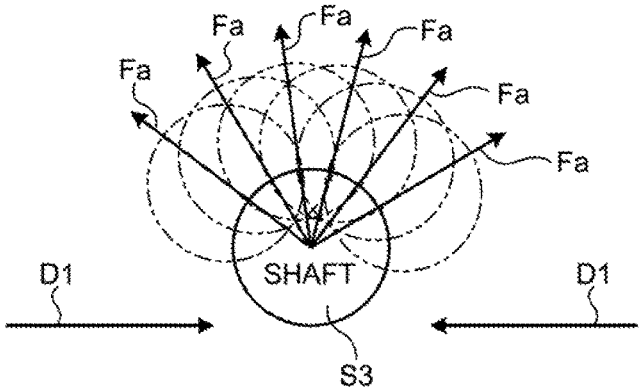
FIG. 9B is a side view of the driven shaft according to the fourth modification.
Figure 9C:
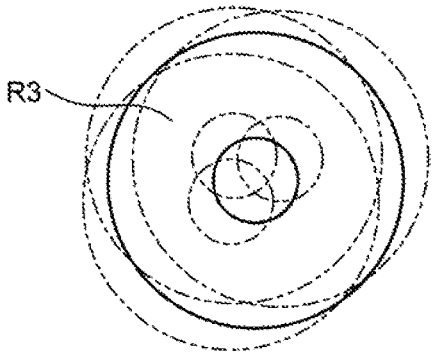
FIG. 9C is a side view of the driven roller according to the fourth modification.

Next, a fourth modification is described. In the first embodiment and the first to third modifications, a rigid body is used for the shaft of the driven roller. However, in the fourth modification, a spring member is used therefor. FIG. 9A is a front view of a driven shaft R3 of a driven roller S3 according to the fourth modification. As illustrated in FIG. 9A, because the driven shaft S3 is a spring shaft, by fixing the opposite ends by bearing portions A11 and A12, the driven shaft S3 can move easily in a state illustrated by a broken line. FIG. 9B is a side view of the driven shaft S3 according to the fourth modification. Because the driven shaft S3 has elasticity, as illustrated in FIG. 9B, the driven shaft S3 can move following the direction of the force Fa at all times, regardless of the transport direction D1 of the banknote M. FIG. 9C is a side view of the driven roller R3 according to the fourth modification. As illustrated in FIG. 9C, the driven roller R3 flexibly moves in a plurality of directions in accordance with the movement of the driven shaft S3.

That is, in the fourth modification, the driven shaft S3 of the driven roller R3 has elasticity that moves the driven roller R3 according to the direction and strength of the force applied thereto due to hitting of the banknote M. According to the transport device 100 of the fourth modification, by moving the driven roller R3 in the direction of the force Fa at all times, the brake force can be absorbed to reduce damage on the banknote M. As a result, more stable and smooth infeed of the banknote M to the roller contact portion C can be performed. Further, because the transport device 100 according to the fourth modification uses an elastic body for the driven shaft S3, the pressurizing force to the drive roller side can be acquired. Furthermore, because substantially similar effects as those of the first embodiment and the first to third modifications can be acquired only by changing the member, flexible movability of the driven shaft adapting to various angles of the force Fa can be realized at a low cost.

In the fourth modification, a spring is exemplified as the member constituting the driven shaft S3; however, the member can be other elastic members such as rubber.

In the descriptions of the first embodiment and the first to fourth modifications, the driven shafts S2 and S3 have been described as being pressed by a pressure from the plate spring B2 with respect to the bearing groove S21. However, the driven shafts can be pressed by a pressure from a compression spring or the like. Further, in the descriptions of the first embodiment and the first to fourth modifications, the driven shaft configured by a rigid body or an elastic body penetrates the driven roller and is fixed. However, the driven shaft does not always need to penetrate the driven roller. For example, it is possible to configure that a plurality of driven shafts are fixed as these shafts sandwich surfaces on the both sides of the driven roller.

In the descriptions of the first embodiment and the first to fourth modifications, individual configurations and operations have been described for each of the first embodiment and the modifications. However, the transport device 100 according to the first embodiment and the respective modifications described above can also include constituent elements specific to other modifications. Further, regarding the combinations of each of the embodiment and the modifications, it is not limited to the combination of two, and can be a combination of three or more and can adopt an arbitrary mode. For example, in the transport device 100, the first modification can be applied to one of the inclined surfaces constituting the bearing groove S21 and the second modification can be applied to the other inclined surface. Alternatively, the transport device 100 can take a mode in which the spring shaft according to the fourth modification is applied to any of the first embodiment and the first to third modifications. Furthermore, one transport device 100 can include all the constituent elements described in the first embodiment and the first to fourth modifications in a compatible range.

According to an aspect of the transport device disclosed in the present application, it is possible to reduce damage caused on paper sheets to be transported bi-directionally.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A transport device comprising:

a first roller that transports paper-sheets in a predetermined transport direction by rotation thereof;

a second roller that rotates with rotation of the first roller, and regardless of from which direction the paper-sheets hit a contact point with the first roller, moves in a direction diagonally forward than a vertical direction with respect to the transport direction; and a bearing groove formed so that a shaft of the second roller moves in a direction diagonally forward than the vertical direction with respect to the transport direction along an inclined surface of the bearing groove, wherein the inclined surface of the bearing groove turns such that an inclination angle thereof is variable according to a force applied thereto due to hitting of the paper-sheets, a range of a turning angle of the bearing groove varies depending on thickness of a transported banknote, the second roller is brought into pressure contact with the first roller, and moves the banknote in a direction in which an impact, caused when the banknote hits a roller contact portion, is absorbed, and the inclination angle of the inclined surface of the bearing groove is variable such that the inclined surface can be made steeper or less steep as a result of the force applied thereto.

2. The transport device according to claim 1, wherein the inclined surface of the bearing groove has elasticity.

3. The transport device according to claim 1, wherein the inclined surface of the bearing groove moves in the transport direction according to a force applied thereto due to hitting of the paper-sheets.

4. The transport device according to claim 1, wherein the shaft of the second roller has elasticity by which the second roller moves according to a force applied thereto due to hitting of the paper-sheets.

* * * * *